US006942486B2

(12) United States Patent
Lvovskiy

(10) Patent No.: US 6,942,486 B2
(45) Date of Patent: Sep. 13, 2005

(54) TRAINING SIMULATOR FOR SHARP SHOOTING

(76) Inventor: Matvey Lvovskiy, 8750 Bay Pkwy., Apt. D5, Brooklyn, NY (US) 11214

( * ) Notice: Subject to any disclaimer, the term of this patent is extended or adjusted under 35 U.S.C. 154(b) by 67 days.

(21) Appl. No.: 10/631,242

(22) Filed: Aug. 1, 2003

(65) Prior Publication Data

US 2005/0181335 A1 Aug. 18, 2005

(51) Int. Cl.[7] ..... F41A 33/00

(52) U.S. Cl. ..... 434/16; 434/11; 434/19; 434/21; 434/22; 434/23

(58) Field of Search ..... 434/11, 16–17, 434/19–27

(56) References Cited

U.S. PATENT DOCUMENTS

| | | | | |
|---|---|---|---|---|
| 3,888,022 A | | 6/1975 | Pardes | |
| 3,964,178 A | | 6/1976 | Marshall | |
| 4,086,711 A | * | 5/1978 | Gammarino et al. | 434/22 |
| 4,137,651 A | | 2/1979 | Pardes | |
| 4,163,328 A | | 8/1979 | Sherburne | |
| 4,290,757 A | * | 9/1981 | Marshall et al. | 434/12 |
| 4,854,595 A | * | 8/1989 | Eichweber | 463/5 |
| 5,366,229 A | * | 11/1994 | Suzuki | 463/5 |
| 6,575,753 B2 | * | 6/2003 | Rosa et al. | 434/16 |
| 2003/0003424 A1 | * | 1/2003 | Shechter et al. | 434/21 |
| 2004/0121292 A1 | * | 6/2004 | Chung et al. | 434/11 |

* cited by examiner

*Primary Examiner*—John M. Hotaling, II
*Assistant Examiner*—Cameron Saadat
(74) *Attorney, Agent, or Firm*—Boris Leschinsky

(57) ABSTRACT

The simulator of the invention is based on a number of functional units connected directly or remotely to the central computer for controlling the operation and recording the shooting results. The weapon unit is untethered and includes a real hand gun equipped with a snap-on emitter unit to send simultaneously two beams of light upon pulling the trigger—a wide angle infrared beam and a narrowly focused and aimed at the target light beam. The infrared beam is registered by the sensor near the screen and a signal indicating a firing event is sent to the computer. The light beam, preferably from a laser source is sent towards the screen, reflected therefrom towards the optical block and travels through a number of fixed and rotating mirrors and through a light divider to the light sensor. That sensor when activated sends the HIT or MISS signal to the computer. Importantly, the optical travel path of the reflected from the screen light beam coincides with the travel path of the light beam generating the target of the screen. Controlled by the computer, rotation of the rotating mirrors both places the target at a specific area of the screen as well as allows accepting of the light beam from the screen by the light sensor. The target generator allows to position the target on the screen in any desirable area or to move it with constant or variable speed along a predetermined complex path on the screen. A video projector allows adding of the pre-recorded of virtual computer-generated surrounding scene onto the screen to increase the degree of realism of the shooting exercise.

8 Claims, 2 Drawing Sheets

TRAINING SIMULATOR FOR SHARP SHOOTING

BACKGROUND OF THE INVENTION

The present invention relates generally to training simulators for improving the marksmanship and firing tactics for combat troops, police, sportsmen's clubs, and other similar groups. In particular, the simulator of the invention relates to devices providing increasing levels of firing difficulty as well as increasing number of moving targets while automatically keeping the score of hits and misses as well as the number of shots fired.

It has long been desired to provide personnel training to improve their skills in aiming and firing shotguns, rifles, handguns, and other weapons. In the past, many different types of target practice and aiming devices have been suggested that use light to simulate the firing of a gun. Such devices help train and instruct shooters by enabling them to practice aiming at a target either indoors or on an open range without actually making use of real projectiles (e.g. shot charges or bullets) The position of a projectile can be simulated by a computer and compared with the target position in order to determine whether the aim is correct.

Over the years a variety of weapon simulators, training devices and other equipment have been suggested, as well as various techniques and methods for their use. Typifying these prior art weapon simulators, training devices, equipment, techniques, and methods are those described in U.S. Pat. Nos. 2,042,174; 2,442,240; 3,675,925; 3,838,856; 3,904,204; 4,111,423; 4,163,557; 4,229,009; 4,534,735; 4,657,511; and 4,799,687.

In some systems, shooters use a gun, which emits a light beam to project a luminous mark on a screen. A successful shot results when the light beam emitted from the gun coincides or aligns with the target on the screen. The cancellation of the target or the display of the simulated object, which has been hit, typically indicates a successful shot by the trainee. Electronically controlled visual and audio indicators for indicating the hit have also been used.

In one prior art system, the flight of the target object is indicated by a constant change in the area and configuration of the target through changing the block area of the mark aperture by movable shutter members. When the mark is hit, the movement of the shutters is ceased and a fixed configuration is projected and the flapping of the bird's wings stops. There is no way of indicating, however, that the target has been hit other than by stopping the movement of the projected image.

When using a light beam gun to shoot a concentrated light beam, such as a laser beam, a target apparatus can be used to indicate the position of impact of the simulated projectile. One typical target apparatus comprises a light-receiving element such as a photo-diode or a photo-conductive cell. When used alone, however, such a light-receiving element can only detect whether or not a light beam discharged by a light gun has landed within a specified range on a target defined by the area of the light-receiving surface. It does not however indicate the exact spot within the specified range where the light beam impacts.

To eliminate these difficulties, it has been suggested to use an electronic target apparatus with numerous light-receiving elements arranged in a plane so as to indicate which of the elements has received a light beam released by a light beam gun. A light beam gun in practical use projects a small shot mark approximating a circle having a diameter of several millimeters. To indicate such a small shot mark on a target, it has been necessary to emit lights to correspond to the impact of simulated projectiles. Voluminous light-receiving elements have been used resulting in complex and expensive electronic training equipment.

Another example of prior art shooting devices involves a clay shooting system utilizing a light-emitting gun and a flying clay pigeon target provided with a light responsive element. Because the light responsive element is provided in the clay, a hit occurs when the light responsive element in the clay bird detects the light beam from the gun. To its detriment, and to the detriment of the user of such a device, lead sighting, which is required in actual clay shooting, cannot be simulated by this system. Moreover, since the clay pigeon actually flies, the clay pigeon has to be retrieved for further use.

Training devices have been provided for the operation of rocket launchers, guided missile launchers, shoulder weapons or weapons of a similar type by providing the operator with conditions which are very close to those likely to be encountered under real firing conditions. Interest has also focused on training in the firing of guns from tanks, combat vehicles or other units of similar types.

Traditional training methods in marksmanship and firing tactics for hunters and other sportsmen, police, military personnel, and others, leave much to be desired from the aspects of realism, cost and practicality. Many firing ranges have limited capacity. Moreover, most existing firing ranges do not provide protection for the shooter against the natural elements such as rain or snow. Because of the noise levels normally associated with firing ranges, they are typically located in remote areas requiring people to have to drive to such remote locations. The ammunition, targets and use costs for the range make such adventures expensive.

In most ranges, the targets are stationary. Furthermore, when live ammunition is used, expense, risks, administrative problems, safety concerns, and government rules and regulations are more burdensome. For initial training in marksmanship and tactics, it is preferred to have an indoor range where shooters can fire simulated projectiles against simulated moving targets.

In other systems, moving targets are projected on an indoor screen from a motion picture film and low power laser beams are aligned with the weapon barrel to simulate the firing of live ammunition. Shooters aim and fire their weapons at targets shown on the screen. Examples of such devices can be found in the U.S. Pat. Nos. 3,888,022; 3,964,178; 4,163,328; and 4,137,651, which are considered the closest prior art to the present invention and are incorporated herewith in their entirety by reference.

These simulators may be useful only for the final stages of training. Another limitation of these systems is the need for a large number of training films associated with various situations encountered by various types of trainees. Yet another limitation is in the repetitive nature of the typical firing situations presented to the trainees. There is no easy way to reprogram the firing aim position, movement direction, or speed depending on the specific needs of a particular category of shooters. Such devices also require a high degree of manufacturing precision to be able to effectively count the shots.

These and other prior art weapon simulators, training devices, equipment, techniques, and methods have met with varying degrees of success, but are often unduly expensive, difficult to use, complex and inaccurate. None of these devices include a system that accurately simulates live ammunition shooting. It is their common limitation that they have a very small number of training situations available, especially those with increasing difficulty of firing conditions. It is, therefore, desirable to provide an improved shooting simulator and process which overcomes most, if not all, of the preceding problems.

SUMMARY OF THE INVENTION

Accordingly, it is an object of the present invention to overcome these and other drawbacks of the prior art by providing a novel training simulator for sharp shooting.

It is another object of the present invention to provide a simulator for sharp shooting allowing for gradually increasing degree of shooting difficulty to include at least the following:

Shooting at a stationary single target;

Shooting at a moving single target;

Shooting at a target appearing periodically and only for a limited time;

Shooting in the above mentioned conditions at night with the use of night vision goggles.

It is a further object of the present invention to provide a sharp shooting simulator allowing to practice taking out the weapon, its handling, aiming, and pulling the trigger with full realism corresponding to firing real live weapons.

It is yet a further object of the present invention to provide a simulator for sharp shooting allowing to further expand the scope of training beyond simple firing, such as for example finding the target in the realistically simulated surroundings.

It is yet another object of the invention to provide a simulator having a universal training methodology equally applicable for various categories and groups of trainees as well as all types of weapons typically used for these trainees.

The simulator of the invention is based on a number of functional units connected directly or remotely to the central computer for controlling the operation and recording the shooting results. The weapon unit is untethered and includes a real hand gun equipped with an emitter unit sending simultaneously two beams upon pulling the trigger—a wide angle infrared beam and a narrowly focused and aimed at the target light beam. The infrared beam is registered by the sensor near the screen and a signal indicating a firing event is sent to the computer. The light beam, preferably from a laser source is sent towards the screen, reflected therefrom towards the optical block and travels through a number of fixed and rotating mirrors and through a light divider to the light sensor. That sensor when activated sends the HIT or MISS signal to the computer. Importantly, the optical travel path of the reflected from the screen light beam coincides with the travel path of the light beam generating the target of the screen. Controlled by the computer, rotation of the rotating mirrors both places the target at a specific area of the screen as well as accepts the light beam from the screen to be registered by the light sensor. The target generator allows to position the target on the screen in any desirable area or to move it with constant or variable speed along a predetermined complex path on the screen. A video projector allows adding of the pre-recorded of virtual computer-generated surrounding scene onto the screen to increase the degree of realism of the shooting exercise.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION OF THE PREFERRED EMBODIMENT OF THE INVENTION

A detailed description of the present invention follows with reference to accompanying drawings in which like elements are indicated by like reference letters and numerals.

Figure 1:
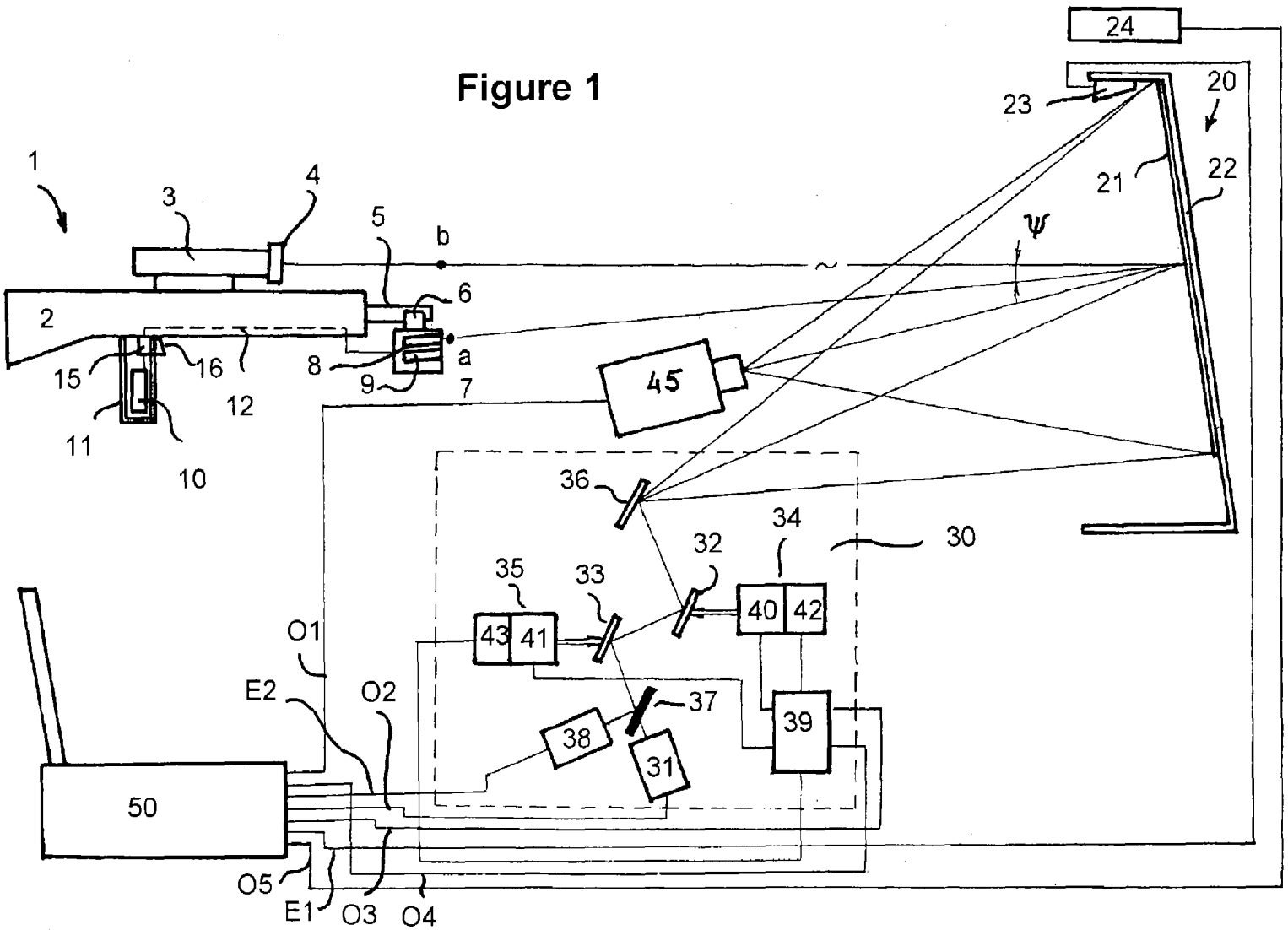
FIG. 1 is a functional diagram of the simulator of the present invention.
Figure 3:
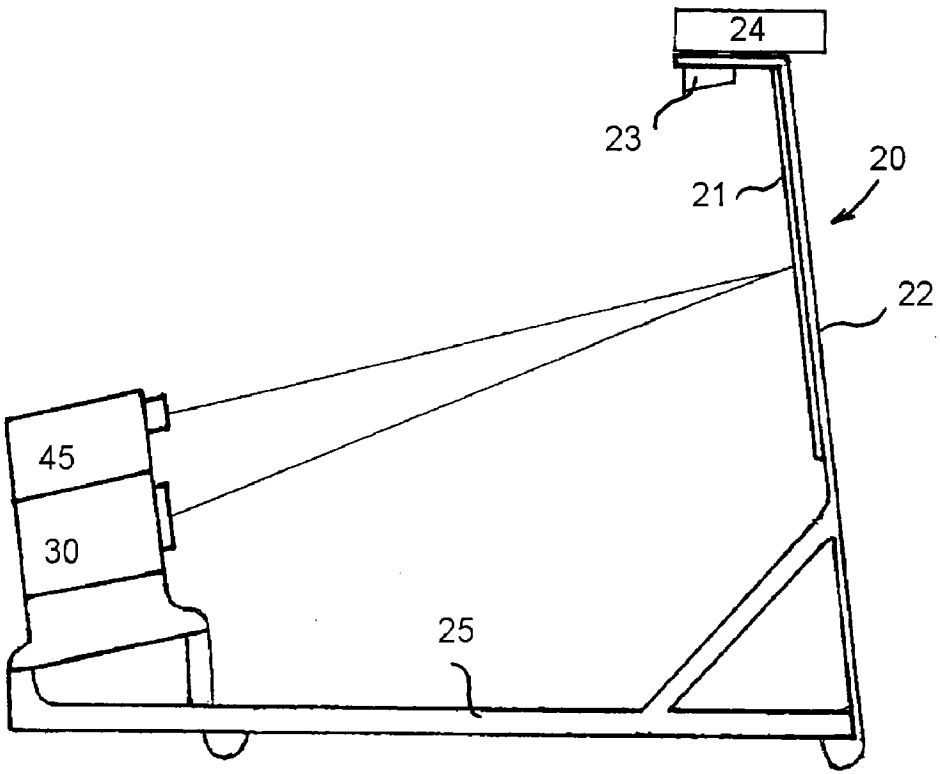
FIG. 3 is a side view of the assembled simulator of the invention.

FIGS. 1 and 3 illustrate the general diagram and the relative positioning of the various units of the proposed simulator. The simulator consists of the weapon unit 1 as well as a screen unit 20, optical unit 30, video projector unit 45, all mounted on the base frame 25. In addition, a computer unit 50 is designed to control all functional aspects of the simulator. The following is a more detailed description of various units of the device.

The weapon unit 1 includes a weapon 2, which is used as a mounting base for all the other elements of the weapon unit 1. All commonly known standard personal firing weapons such as shotguns, rifles, pistols, and handguns can be used as the weapon unit 2. An optical aiming device 3 and a telescopic viewfinder 4 are mounted on the upper part of the weapon 2. The viewfinder 4 serves to provide a high contrast view of the target on the screen unit 20 and includes an optical lens with the optical resolution of about 0.2 d.

Emitting unit 7 is removably attached to the distal end of the weapon 2, typically to the end of the barrel 5, for example with the help of a quick snap-on spring-biased C-shaped bracket 6. The emitting unit 7 includes a light emitter 8 and cordless firing event detection means such as an infrared emitter 9. The light emitter 8 is preferably a laser emitting a firing light beam with a light wavelength $\lambda 1$ and equipped with an appropriate focusing lens although other light emitting devices are also contemplated to be included in the scope of the invention. The focusing lens is designed to provide an appropriate diameter of the laser beam emitted from the weapon 2. In its preferred configuration, the focusing lens forms a beam of approximately 10 to 20 mm in diameter.

The infrared emitter 9 is similar in design to those emitters used in remote control devices for home entertainment electronics such as TVs, VCRs, etc. It is activated simultaneously with the light emitter 8. Electrical power to the emitter 7 is provided by a battery 10 located for example in the ammunition section 11 of the weapon 2. Battery 10 is connected with the emitter unit 7 by a cable 12. Rechargeable Nickel-Cadmium batteries are the preferred choice for the battery 10.

Besides the battery 10, the ammunition section 11 houses a switch 15 designed to connect the emitter unit 7 with the battery 10 when the trigger 16 of the weapon 2 is pulled to provide electrical power thereto. A commonly known micro-switching design is most preferable for use as a switch 15.

All shooting simulators of various designs having a light source positioned away from the firing line of the barrel have to have provisions for compensating for an aiming angle offset. In the weapon unit 1 of the present invention, the emitter unit 7 is tilted towards the barrel 5 of the weapon 2 at an angle Ψ, which is calculated from the following mathematical equation:

$$ARCTG\ \Psi = H/L,$$

in which "H" is the distance between point "a" and point "b" (see FIG. 1). Point "a" is defined as the beginning of the light path and point "b" is located at the intersection of an imaginary vertical line drawn through point "a" and a line of aim of the weapon 2. "L" is the distance between point "b" and the screen unit 20.

Figure 2:
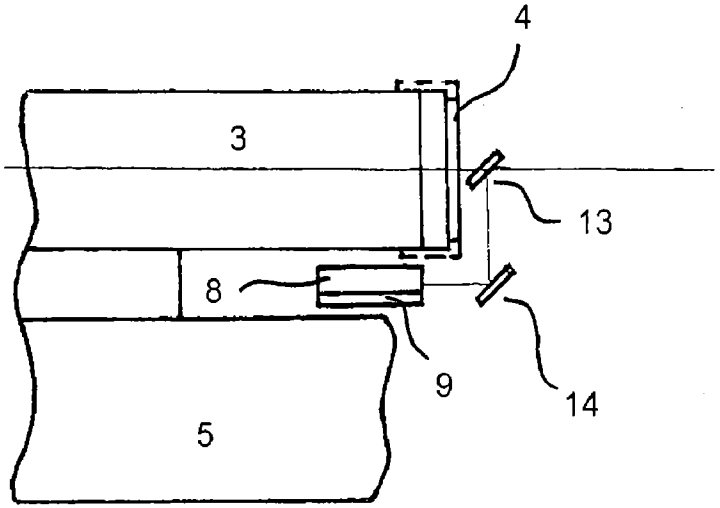
FIG. 2 is a side view of the alternative variation of the simulator in which the telescopic viewfinder is combined with the laser emitter.

FIG. 2 illustrates one useful alternative variation of the weapon unit 1 of the invention. A sniper's rifle equipped at the factory with a standard optical aim device is adapted to serve as a weapon 2. In that case, the telescopic viewfinder 4 is combined with the light emitter 8 and a narrow light beam divider 13 is added to the unit 1. The divider 13 is positioned centrally and tilted at a 45-degree angle to the optical axis of telescopic viewfinder 4 as shown on FIG. 2. The light beam divider 13 is chosen such that at least about 70% of the ambient light is passed therethrough, while at least about 70% of the light beam from the light emitter 8 such as preferably a laser light beam is reflected. The light beam divider is preferably a dichroic mirror. A mirror 14 is positioned centrally and in parallel to the light beam divider 13 at the same angle of 45-degrees to the optical axis of the light emitter 8.

The screen unit 20 includes a screen 21 equipped with an opaque cover 22 located behind it to prevent any light beams of passing through and behind the screen 21 and improving the visibility of the images projected onto the screen 21 in conditions of bright ambient light. The screen 21 is made from a material having a diffusing reflective surface with the reflection capacity in the range of visible light of at least 80%. Its diffusing capacity is preferably about 20 to 30 degrees at the level of a 50% reduction of its reflective coefficient. While the preferred distance between the trainee and the screen 21 is about 15–18 ft, the size of the screen 21 is preferably at least 4×3 ft.

In the upper portion of the screen 21, an infrared sensor 23 is located as well as the display of hits and misses 24.

The infrared sensor 23 is designed to respond to the infrared beams sent by the infrared emitter 9 in the weapon unit 1. Every time when the trigger 16 is pulled, the infrared beam is sent out by the emitter 9 and the registered as a firing event by the infrared sensor 23, which in turn sends out a signal to a central computer 50 to indicate the presence of the firing event. Since the trigger 16 supplies electrical power to the entire emitter unit 7 including both the light emitter 8 and the infrared emitter 9, both beams are generated at the same time. That way the central computer performs a registration of the firing event by the light emitter 8 only by detecting the presence of the infrared signal from the infrared emitter 9. If the target is not hit as will be explained in more detail below, the computer registers the firing as a miss without the need to detect the presence or position of the light beam from the light emitter 8. Thus, the dual beam emitter 7 allows for significant simplification of the system of the present invention in comparison with other simulators known in the prior art. At the same time, full trainee mobility is maintained without the need for a cable to connect the weapon unit 1 to the central computer 50 to detect the firing event.

The visual display for hits and misses 24 is designed to inform the trainee as well as the observers about the quality of the firing and weather the target was hit or not. In its most basic configuration, the display 24 comprises light diodes of two different colors, red and green for example. If the shot is successful, the green light comes on, if not then the red light is illuminated. Optionally, additional information may be displayed such as the number of shots and the updated score of hits and misses as well as the information about the target.

As shown on FIG. 3, the screen unit 20 is rigidly mounted on the base frame 25. Also mounted on the same frame is the optical unit 30 to include an optical target generator 31, rotating mirrors 32 and 33 with respective drives 34 and 35 as well as their control unit 39, a fixed mirror 36, a light divider 37, and a light sensor 38.

The optical target generator 31 is present to form a visible target onto a screen 21. It is preferably designed based on a laser light diode emitting a light wavelength λ2 equipped with a corresponding power supply, optical lens unit to focus the laser light and a switching device to turn it on and off depending on the command signals from the central computer 50. Following the reflection through the mirrors 32 and 33, the optical lens unit of the target generator 31 preferably generates on the screen 21 a round bright enough target with the diameter between about 10 and about 20 mm. The target should be visible even in the presence of bright ambient light.

Rotating mirrors 32 and 33 are positioned to rotate about two axes located perpendicular to each other. They are designed to reflect the projected optical target beam from the optical target generator 31 onto the fixed mirror 36 and then onto any desired position on the screen 21. Importantly, the mirrors 32 and 33 are positioned such that the optical axis of the target generator 31 coincides at all times (irrespective of the position of the rotating mirrors 32 and 33) with the optical axis of the light sensor 38 all the way from the light divider 37 to the screen 21.

The design of the rotating mirrors 32 and 33 also allows providing for a moving target on the screen 21 depending on the program supplied by the central computer 50. The movement of the target may be done with a constant or variable speed to further increase the firing difficulty for the trainee.

Each mirror 32 and 33 is rotated individually by an independently controlled drive 34 and 35 respectively. Each of these drives consists in turn of reversible servomotors 40 and 41. Control unit 39 comprises two digital-to-analog converters and supplies both motors 40 and 41 with an appropriate electrical signal of a certain form and amplitude as dictated by the central computer 50. The position of the mirrors 32 and 33 is detected at all times and sent back to the computer 50 by the digital feedback position sensors 42 and 43, which are mechanically connected to the motors 40 and 41 respectively. Alternatively, other drive and position detection means can be used such as for example with the use of stepper motors.

In a variation of the optical unit of the invention (not shown on the drawings), a single movable mirror may be deployed in place of two rotating mirrors 32 and 33 and even a fixed mirror 36. Such movable mirror can be independently tilted in two perpendicular directions to provide coverage of the entire area of the screen 21 and reflect the light beams between the screen and the light divider.

The light divider 37 allows transmission therethrough of preferably at least about 70% of the light with the wavelength λ2 from the optical target generator 31 and reflects preferably at least about 70% of the light wavelength λ1 generated by the light emitter 8 located on the weapon unit 1. Well-known optical filters with appropriate transmission and reflection spectral wavelengths can be used as a light divider 37. For example, one such filter is a dichroic mirror as described in detail in the U.S. Pat. No. 4,163,328 referenced above. The light divider 37 is located at a crossing point of the optical axis of the target generator 31 and located perpendicular thereto the optical axis of the light sensor 38. The light divider 37 is placed at a 45-degree angle to both these optical axes and so that its reflective surface is facing towards the light sensor 38.

The light sensor 38 can be designed as a miniature video camera capable of signal transmission and having at least 300 pixels of resolution. Its operation is synchronized with the operation of the central computer 50. The light sensor 38 is always transmitting the video signal to the computer 50 when turned on. However, the computer 50 digitally records the signal from the light sensor 38 only at the time of firing as detected by the infrared sensor 23. Optionally, instead of recording a picture from the sensor 38, a simple presence of light can be detected and recorded as YES or HIT in case of light being present or NO or MISS in case there is no light detected.

A video projector 45 is also fixedly mounted on the base frame 25 at an appropriate angle to the screen 21. It is designed to project onto the screen 21 a real, virtual, or computer-generated surroundings situation for the trainee to further increase the sense of realism during the shooting exercise.

The central computer 50 controls the entire operation of the simulator of the present invention and records the results of the exercise. It is connected with every element of the simulator of the present invention as follows:

input E1 accepts the signal from the infrared sensor 23;

input E2 accepts the signal from the light sensor 38;

output O1 controls the operation of the video projector 45;

output O2 controls the target generator 31;

outputs O3 and O4 control operation of the control unit 39 to define the position of the mirrors 32 and 33 (at the same time, the output signals from the control unit 39 are fed into the servo-motors 40 and 41 while their respective position is detected and fed back into the computer by the feedback position sensors 42 and 43);

output O5 transmits the HIT or MISS signal to the display 24.

The central computer 50 allows to choose among the various training programs as well as to keep the records of training and instantly inform the trainee and the observers of the progress. Optional information can also be retained in the computer such as a history of success for a particular person and so on.

The screen of the computer 50 may be used to display the target area of the screen 21 as recorded by the light sensor 38 at the time of firing as well as the firing results. Besides, the computer 50 can be advantageously used to perform one or more of the following:

calibration of the light sensor 38;

choose among various types of targets and adjust its size;

choose among the various pre-recorded or computer-generated shooting situations for projection by the video projector 45;

review the score and results of firing exercises.

A notebook or a desktop personal computer may be used preferably as a central computer 50 of the present invention provided they have enough memory and computing capacity to control the entire operation of the sharp shooting simulator of the invention.

Advantageously, the use of the computer 50 allows the training routine for various types of users such as hunters, snipers, police, military, etc. to be done with an increasing degree of shooting difficulty.

In a typical training scenario, the user data is first entered into the computer 50 and includes for example the trainee name, number, date and time of exercise. The training routine is then chosen and includes for example firing at first at a stationary single target in the center of the screen 21. After a predetermined time, the video projector 45 may be activated to incorporate a photograph of urban or suburban surroundings in which the target may be located.

Following some predetermined period of time to allow the trainee to familiarize with the surroundings, the target generator 31 is activated to project a stationary round bright target dot onto the screen 21. To further increase the degree of difficulty, the target dot then starts to move along a complex pattern and with variable speed. After that, the path of target movement takes it behind natural obstacles so that the target disappears for some time from the screen and then comes back on the other side of the obstacle. Such movements of the target are the result of the controlled movements of the mirrors 32 and 33 as well as the turning off and on of the optical target generator 31 by the program of the computer 50. The mirrors 32 and 33 are rotated about their respective axes by the servomotors 40 and 41 as described above in more detail.

As in real life, the trainee aims the crosshair of the optical aiming device 3 equipped with the telescopic viewfinder 4 at the target located on the screen 21. The trigger 16 is then pulled causing the switch 15 to supply electrical power to the emitter unit 7 via the cable 12 for a predetermined short period of time. The light emitter 8 and the infrared emitter 9 are then energized. The infrared emitter 9 sends out a wide angle infrared beam to be registered by the infrared sensor 23 located on the screen 21. The sensor 23 then sends a signal indicating the firing event to the central computer 50 for further processing. The central computer 50 both stores the timing of the firing event and activates the recording from the light sensor 38.

Simultaneously with the activation of the infrared emitter 9, the light emitter 8 is also activated and sends a light beam towards the target on the screen. The beam is reflected by the screen 21 and redirected towards the fixed mirror 36 and then towards the rotating mirrors 32 and 33, then towards the light divider 37, and finally into the light sensor 38. The light sensor 38 in turn transmits the signal to the input E2 of the central computer 50. If the aiming of the weapon 2 towards the target was correct, the path of travel of the light beam from the weapon 2 towards the light sensor 38 coincides (but in the opposite direction) with the travel path of the light beam from the target generator towards the screen 21. The light sensor 38 sends a HIT signal as it is recorded by the central computer 50. Incorrect aiming will result in the misalignment of these light travel paths and the MISS result will be recorded. This system provides for a simple but very precise recording of the firing results without the need for costly optical equipment made with high precision. The updated results of the firing score are displayed to the trainee on the display 24 located above the screen unit 20.

The sharp shooting simulator of the present invention has the following important advantages in comparison with the existing devices disclosed in the prior art:

the optical unit containing rotating mirrors allows to position the target at any point along the screen and also to move it on the screen in any desired direction and with any constant or variable speed. This allows for a great variety of training exercises;

recording of HITS and MISSES is based on the concept of alignment of travel paths between the light beam from the weapon and the light beam to generate the target. This concept allows the accuracy of recording close to 100% across the entire area of the screen, all without the use of expensive optical components;

the operation of the central computer allows the use of a video projector to add the high degree of realism to the exercise and also to coordinate the operation of all major elements of the simulator in any desired training routine as well as to record its results;

there is no need to a traditional special weapon tethered to the central computer by a cable and therefore limiting the movements of the trainee. The simulator of the present invention allows easily replacing one hand gun with another and therefore giving the trainees the ability to practice with a number of different weapons even during the same training session.

Although the invention herein has been described with respect to particular embodiments, it is understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A training simulator for sharp shooting comprising:

a weapon unit equipped with an emitter unit comprising a light emitter and a cordless firing event detection means, said weapon unit also equipped with a means to activate both the light emitter and the firing event detection means simultaneously upon pulling a trigger of said weapon unit, a screen unit comprising a screen having a diffusing reflective surface and a cordless firing event detection sensor positioned to receive a signal sent by said firing event detection means and adapted to send out a firing event electrical signal, an optical unit having an optical target generation means to project an optical target onto said screen, said optical unit also equipped with a sensing means to detect whether said target has been hit by a light beam from said light emitter and reflected by said screen, said sensing means adapted to send an electrical signal, and a central computer adapted to control the position of said target by operating said optical target generation means, said central computer adapted to receive said firing event electrical signal from said cordless firing event detection sensor, said central computer adapted also to receive the electrical signal from said sensing means to determine whether the target has been hit.

2. The simulator as in claim 1, wherein said cordless firing event detection means is an infrared emitter and said cordless firing event detection sensor is an infrared sensor.

3. The simulator as in claim 1, wherein said screen having a reflection capacity in the range of visible light of at least 80 percent, said screen having a diffusing capacity from about 20 to about 30 degrees at the level of about 50 percent reduction of its reflective coefficient.

4. A training simulator for sharp shooting comprising:

a weapon unit equipped with a light emitter and a means to activate the light emitter upon pulling a trigger of said weapon unit to generate a firing light beam, a screen having a diffusing reflective surface, an optical unit having an optical target generation means to project an optical target beam onto said screen, said optical unit equipped with a sensing means adapted to send an electrical signal indicating a presence or absence of a firing light beam from said light emitter as reflected by said screen, said optical unit comprising a movable mirror system having a fixed position mirror and a rotating mirror adapted to both direct said optical target beam from said optical target generation means to any predetermined area of said screen and to direct said firing light beam from said screen into said sensing means, said moveable mirror system providing for a common travel path along at least a portion of the optical axes of said light beam and said optical target beam, and a central computer adapted to control the position of said optical target on said screen by operating said optical target generation means, said central computer adapted to receive the electrical signal from said sensing means to determine whether the target has been hit.

5. The simulator as in claim 4, wherein said movable mirror system comprising a pair or rotating mirrors and a fixed mirror, the position of said rotating mirrors individually controlled by said central computer, said mirrors rotating about optical axes perpendicular to each other.

6. The simulator as in claim 5, wherein each of said rotating mirrors further comprising a servomotor controlled by a common control unit operated by said central computer.

7. The simulator as in claim 6, wherein each of said servomotors is further equipped with a position sensor connected to said central computer to indicate the position of each of the rotating mirrors.

8. A training simulator for sharp shooting comprising:

a weapon unit equipped with an emitter unit comprising a light emitter to send a firing light beam and an infrared emitter to send a firing event infrared beam, said weapon unit also equipped with a means to activate both the light emitter and the infrared emitter simultaneously upon pulling a trigger of said weapon unit, a screen unit comprising a screen having a diffusing reflective surface and an infrared sensor positioned to receive the infrared beam from said infrared emitter and adapted to send out a firing event electrical signal, an optical unit having an optical target generation means to project an optical target beam onto said screen, said optical unit equipped with a light sensor adapted to send an electrical signal indicating a presence or absence of a firing light beam from said light emitter after being reflected by said screen, said optical unit comprising a movable mirror system adapted to both direct said optical target beam from said optical target generation means to any predetermined area of said screen and to direct said firing light beam from said screen into said sensing means, said moveable mirror system providing for a common travel path along at least a portion of the optical axes of said light beam and said optical target beam, and a central computer adapted to control the position of said target by operating said optical target generation means, said central computer adapted to receive said firing event electrical signal from said infrared sensor, said central computer adapted also to receive the electrical signal from said light sensor to determine whether the target has been hit.

* * * * *